US009240642B2

(12) United States Patent
Sagayama et al.

(10) Patent No.: US 9,240,642 B2
(45) Date of Patent: Jan. 19, 2016

(54) CONNECTOR

(71) Applicant: Molex, LLC, Lisle, IL (US)

(72) Inventors: Akira Sagayama, Yamato (JP); Ayako Ida, Yamato (JP); Akinori Mizumura, Yokohama (JP)

(73) Assignee: Molex, LLC, Lisle, IL (US)

( * ) Notice: Subject to any disclaimer, the term of this patent is extended or adjusted under 35 U.S.C. 154(b) by 65 days.

(21) Appl. No.: 14/278,130

(22) Filed: May 15, 2014

(65) Prior Publication Data

US 2014/0342598 A1 Nov. 20, 2014

(30) Foreign Application Priority Data

May 15, 2013 (JP) ..... 2013-102836

(51) Int. Cl.
*H01R 12/78* (2011.01)

(52) U.S. Cl.
CPC ..... *H01R 12/78* (2013.01)

(58) Field of Classification Search
CPC ..... H01R 23/66; H01R 4/242; H01R 13/506; H01R 12/777; H01R 12/714; H01R 12/774; H01R 12/52; H01R 12/59
USPC ..... 439/493–495, 67, 74, 492
See application file for complete search history.

(56) References Cited

U.S. PATENT DOCUMENTS 7,674,114 B2 * 3/2010 Tanaka ..... H01R 12/57 439/74
8,465,328 B2 * 6/2013 Iida ..... H01R 4/58 439/660
8,998,624 B2 * 4/2015 Ida ..... H01R 13/40 439/74

FOREIGN PATENT DOCUMENTS

JP 1994-302961 5/1996

* cited by examiner

*Primary Examiner* — Xuong Chung Trans
(74) *Attorney, Agent, or Firm* — James A. O'Malley

(57) ABSTRACT

A connector is disclosed having a flat cable connecting portion connected to a flat cable and a flat mating portion mated with another connector. The connector comprises a plurality of terminals arranged on the mating portion for establishing contact with terminals on the other connector, a conductive connecting portion exposed on the cable connecting portion and connected to conductive trace connecting portions on the flat cable, and a plurality of wiring lines extending from the mating portion to the cable connecting portion, each one electrically connecting a terminal to the corresponding conductive trace connecting portion. The conductive connecting portion has a protrusion formed on the wiring lines. The upper surface of the protrusion is substantially the same height as one outer surface of the cable connecting portion.

14 Claims, 11 Drawing Sheets

CONNECTOR

REFERENCE TO RELATED APPLICATIONS

The Present Disclosure claims priority to prior-filed Japanese Patent Application No. 2013-102836, entitled "Connector," and filed with the Japanese Patent Office on 15 May 2013, the content of which is fully incorporated in its entirety herein.

BACKGROUND OF THE PRESENT DISCLOSURE

The Present Disclosure relates, generally, to a connector.

Electronic devices typically use connectors to connect components mounted on a printed circuit board to a flat cable such as a flexible printed circuit (FPC). An example is disclosed in Japanese Patent Application No. 1994-302961, the content of which is fully incorporated in its entirety herein.

FIG. 11 is an exploded view of a typical conventional connector. In this drawing, 901 is a flexible circuit board including a plurality of conductors 961 formed by patterning copper foil formed on one surface of a resin sheet 915. The upper surfaces of the conductors 961 are covered with resin film 916. A plurality of through-holes 917 are also formed in the end portion of the flexible circuit board 901. Each through-hole 917 is formed between adjacent conductors 961. The resin film 916 is removed near the end portion to expose the conductors 961.

Further, 811 is the housing of the connector used to connect the flexible circuit board 901 to a printed circuit board (not shown), and 851 denotes the terminals in the connector. One end of each terminal is soldered to a connector exposed on the surface of the printed circuit board. An opening 812 extending in the direction of the row of terminals 851 is formed in the housing 811 to expose the terminals 851 inside the opening 812. A recessed portion 813 for accommodating an end of the flexible circuit board 901 is formed on the upper surface of the housing 811. The three sides of the recessed portion 813 are formed by a front wall portion 815 and a pair of side wall portions 814.

Also, 821 is a cover member with comb tooth guides 822 protruding on one side. Each comb tooth guide 822 is inserted into a space 852 between the terminals 851 exposed inside the opening 812.

When the flexible circuit board 901 is connected to the connector, the end portion of the flexible circuit board 901 is inserted into the recessed portion 813 with the exposed conductors 961 facing the upper surface of the housing 811. At this time, each of the exposed conductors 961 faces an exposed terminal 851 inside the opening 812, and each through-hole 917 faces a space 852 between the terminals 851. The cover member 821 is oriented so that the comb tooth guides 822 face the upper surface of the housing 811, and is attached to the housing 811 above the flexible circuit board 901. At this time, each comb tooth guide 822 passes through a through-hole 917 and is inserted into and engages with a space 852 between terminals 851. In this way, the flexible circuit board 901 is pressed against the housing 811, the conductors 961 make contact with the terminals 851, and the flexible circuit board 901 is connected to the connector.

SUMMARY OF THE PRESENT DISCLOSURE

In a typical conventional connector, the comb tooth guides 822 on the cover member 821 are inserted into and engage with the gaps 852 between exposed terminals 851 in the opening 812. Consequently, the height dimension of the housing 811 cannot be reduced, and the pitch between terminals 851 cannot be narrowed. This makes it difficult to lower the profile and more highly integrate electrodes as devices get smaller and more integrated.

It is an object of the Present Disclosure to solve the aforementioned problems by providing a reliable sheet connector in which protrusions are formed in the wiring lines connected to the conductive trace connecting portions of a flat cable, so that the flat cable can be connected more easily and reliably, can be manufactured more easily, and can be made more reliable even while making the configuration of the flat connector simpler, more integrated, more compact, and lower in profile.

The Present Disclosure discloses a connector having a flat cable connecting portion connected to a flat cable and a flat mating portion mated with another connector. The connector comprises a plurality of terminals arranged on the mating portion for establishing contact with terminals on the other connector, a conductive connecting portion exposed on the cable connecting portion and connected to conductive trace connecting portions on the flat cable, and a plurality of wiring lines extending from the mating portion to the cable connecting portion. Each wire connects a terminal to the corresponding conductive trace connecting portion. The conductive connecting portion having a protrusion formed on the wiring lines, and the upper surface of the protrusion being substantially the same height as one outer surface of the cable connecting portion.

In another connector of the Present Disclosure, the cable connecting portion has connecting portion accommodating openings passing through the cable connecting portion in the thickness direction, and each conductive connecting portion is exposed inside each connecting portion accommodating opening.

In another connector of the Present Disclosure, each connecting portion accommodating opening is wider than the conductive connecting portion.

In another connector of the Present Disclosure, the cable connecting portion includes insulating base film arranged on one surface of the wiring lines and an insulating cover film arranged on the other surface of the wiring lines; each connecting portion accommodating opening includes an opening passing through the insulating base film in the thickness direction and an opening passing through the insulating cover film in the thickness direction; and the upper surface of each protrusion is substantially the same height as the outer surface of the base film.

In another connector of the Present Disclosure, the conductive connecting portions are arranged side by side so as to form a plurality of rows extending in the width direction of the connector, and conductive connecting portions in adjacent rows are arranged so as to be staggered at half a pitch relative to each other in the thickness direction of the connector.

In the connector of the Present Disclosure, protrusions are formed in the wiring lines connected to the conductive trace connecting portions of a flat cable. In this way, the flat cable can be connected more easily and reliably, can be manufactured more easily, and can be made more reliable even while making the configuration of the flat connector simpler, more integrated, more compact, and lower in profile.

BRIEF DESCRIPTION OF THE FIGURES

The organization and manner of the structure and operation of the Present Disclosure, together with further objects and advantages thereof, may best be understood by reference to the following Detailed Description, taken in connection with the accompanying Figures, wherein like reference numerals identify like elements, and in which.

DESCRIPTION OF THE PREFERRED EMBODIMENTS

Figure 1A:
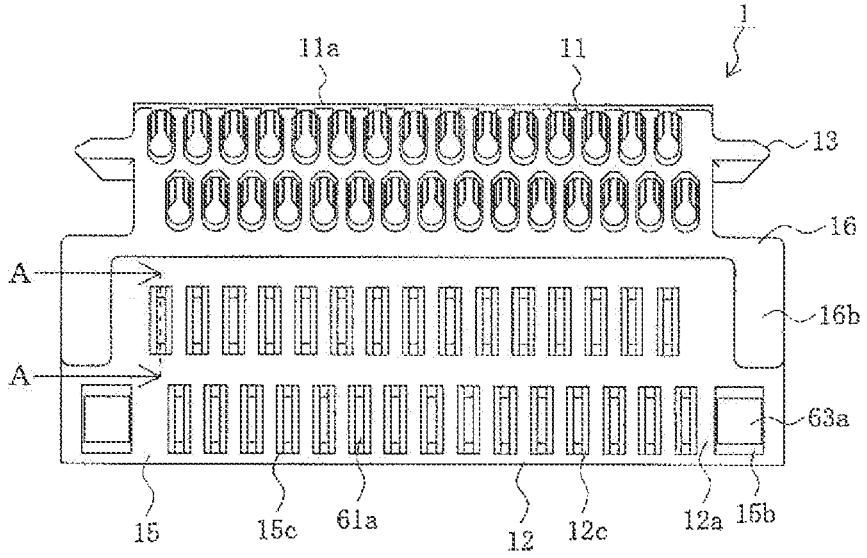
FIG. 1 is a plan view of a female connector in an embodiment of the Present Disclosure, in which FIG. 1(*a*) is view of the connector from the side opposite the mated surface, and FIG. 1(*b*) is a diagram showing the connector from the side with the mated surface.

While the Present Disclosure may be susceptible to embodiment in different forms, there is shown in the Figures, and will be described herein in detail, with the understanding that the Present Disclosure is to be considered an exemplification of the principles of the Present Disclosure, and is not intended to limit the Present Disclosure to that as illustrated.

In the Present Disclosure, directional representations—i.e., up, down, left, right, front, rear and the like, used for explaining the structure and movement of the various elements of the Present Disclosure, are relative. These representations are appropriate when the elements are in the position shown in the Figures. If the description of the position of the elements changes, however, it is assumed that these representations are to be changed accordingly.

Referring to the Figures, 101 is the second connector among the connectors of the Present Disclosure and is a male connector. This connector is mounted on a mounting member not shown in the drawings, and is connected electrically to the female connector 1 serving as the first connector described below. The mounting member can be any type of board commonly used in electronic devices. Examples include printed circuit boards, flexible flat cables (FFC), and flexible printed circuit boards. This is referred to simply as the board in the following explanation.

The male connector 101 that is the connector opposite the female connector 1 has a plate-like main body portion 111 with a rectangular planar shape. The main body portion 111 includes: a reinforcing layer 116 serving as a plate-like reinforcing portion, and is a flat, thin plate member on the mounted surface side (the side opposite the mated surface) (downward in FIGS. 2-3); a base film 115 serving as a male board portion, which is a plate-like second board portion or an insulating thin plate portion having a slender, band-like shape; and a conductive pattern 151 serving as a male conductive portion, which is a plate-like first conductive portion arranged on one surface of the base film 115 (the mated surface side). A plurality of conductive patterns 151 are separated by pattern separating space 152. The dimension of the main body portion 111 in the thickness direction is from 0.3 to 0.5 mm, but this dimension can be changed if necessary.

The base film 115 can be any material insulating material, including resins such as polyimide. A reinforcing layer 116 serving as a plate-like reinforcing portion is a flat, thin plate member provided on the other surface of the base film 115 (the surface on the mounted surface side). The reinforcing layer 116 is made of a metal such as stainless steel, but can also be made of some other material such as a resin or a composite material containing glass fibers or carbon fibers.

The conductive patterns 151 are formed, for example, by applying copper foil having a thickness ranging from several to several tens of μm on one surface of the base film 115 and then by patterning the copper foil using an etching process. Two separate rows are arranged in parallel along the front end 111*a* and the rear end 111*b* extending in the longitudinal direction of the main body portion 111, which is also the transverse direction of the male connector 101, and the adjacent conductive patterns 151 in each row are separated from each other and arranged at a predetermined pitch.

The row along the front end 111*a* and the row along the rear end 111*b* are arranged so as to be staggered one-half pitch with respect to the longitudinal direction of the main body portion 111. In other words, the conductive patterns 151 in the row along the front end 111*a* and the conductive patterns 151 in the row along the rear end 111*b* are arranged in a zigzag pattern staggered by one-half pitch with respect to the traverse direction (width direction) of the male connector 101.

Each conductive pattern 151 is a male connector and a first connector functioning as a plurality of conductive wires arranged in parallel. Each one is exposed on the mated surface of the main body portion 111, and has a single protruding terminal 153 serving as a male terminal and opposing terminal. In the example shown in the drawings, the conductive patterns 151 and the protruding terminals 153 are arranged in parallel to each other at a predetermined pitch, for example, 0.2 to 0.4 mm, so that two rows extend in the width direction of the main body portion 111. However, the number, pitch, and arrangement of conductive patterns 151 and protruding terminals 153 are not limited to the example shown in the drawings. They can be changed if necessary.

Each protruding terminal 153 is a member protruding from the surface of a conductive pattern 151, and is integrated with the conductive pattern 151, for example, by performing etching using the photolithographic technique. The dimension of the protruding terminals 153 in the height direction can range, for example, from 0.1 to 0.3 mm, but this can be changed if necessary.

Also, the dimension of the upper surface and transverse section of the protruding terminals 153 is preferably greater in the longitudinal direction than in the lateral direction. They preferably have a shape which has an inclined portion in the forward direction, for example, a hexagonal shape or a pentagonal shape similar to home plate in baseball with the point facing forward. However, the shape is not limited to the example shown in the drawing. It can be changed to any shape, such as a round or oval shape.

Figure 2:
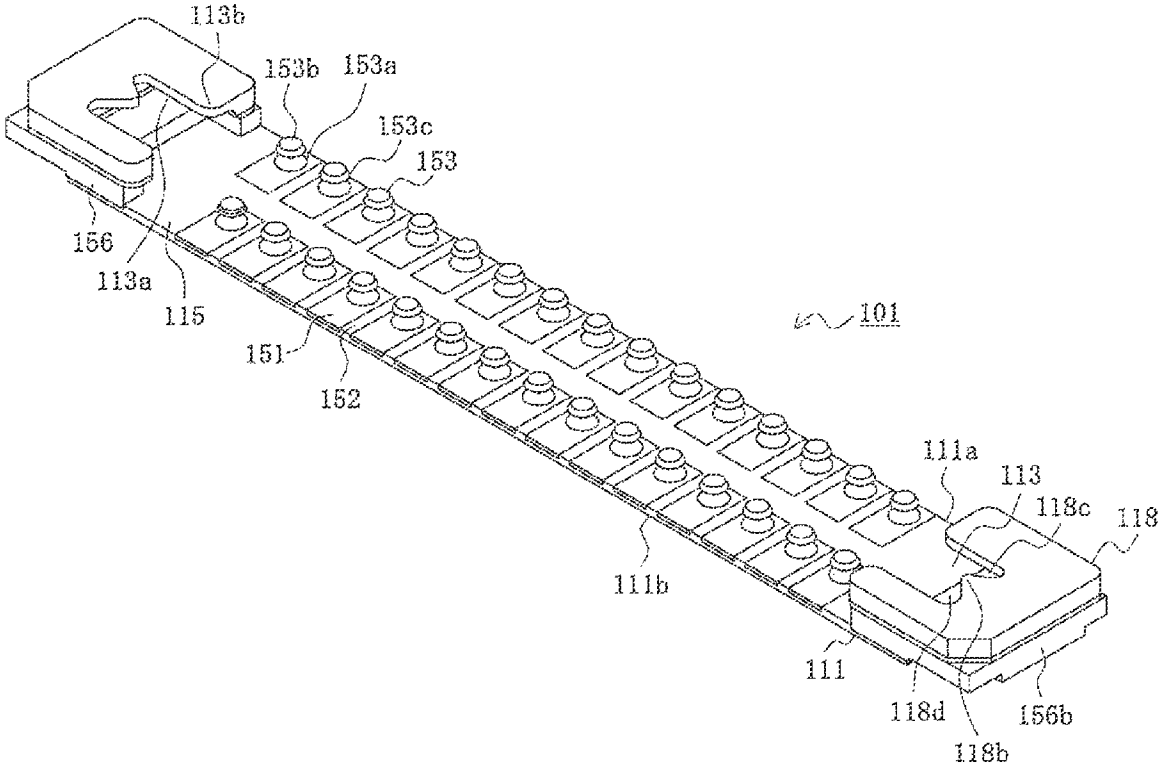
FIG. 2 is a perspective view of a male connector.
Figure 3:
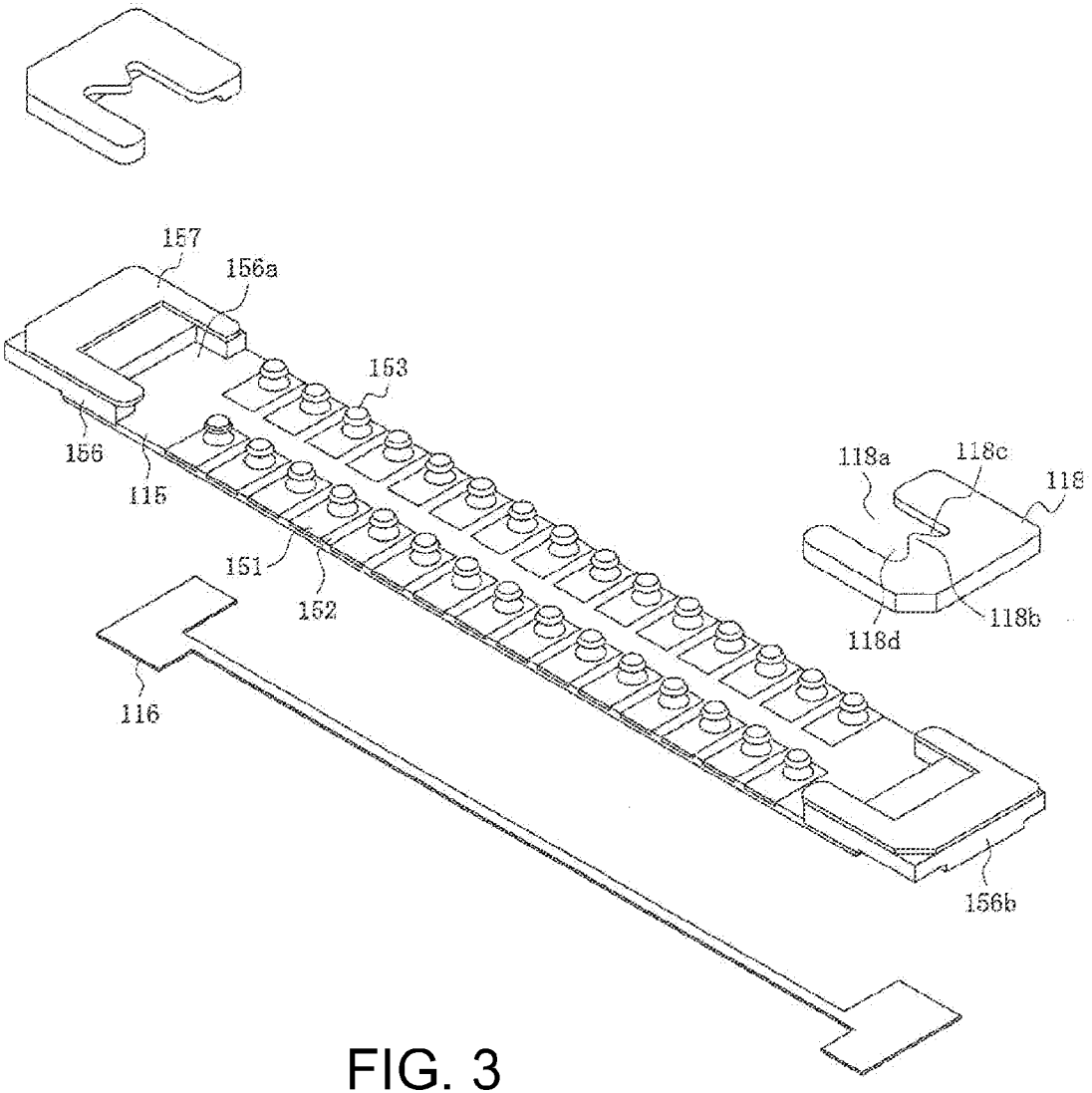
FIG. 3 is an exploded view showing the layered structure of the male connector of FIG. 2.

The shape of the side surface of the protruding terminals 153 in the present embodiment is preferably concave as shown in FIG. 2. More specifically, in the protruding terminals 153, the width dimension of the base end portion 153*a*, which is the portion connected to the surface of the conductive patterns 151, is greater than the width dimension of the front end portion 153*b*, which is the upper end portion. The side surface portion 153*c* between the base end portion 153*a* and the front end portion 153*b* is smooth for insertion inward in the width direction relative to the base end portion 153*a* and the front end portion 153*b*. The shape of the side surface portion 153*c* is preferably a gradual, continuous curve. However, it may also be a curved surface consisting of a plurality of connected inclined surfaces.

Each conductive pattern 151 is connected electrically to the corresponding mounting pattern (not shown) which corresponds to the other surface of the base film 115 (the side with the mounting surface). The electrical connection can be established, for example, via a through-hole formed in the base film 115. Each mounting pattern is connected via solder to a connection pad formed on the surface of the board serving as the mounting member. In this way, the male connector 101 can be mounted to the board, and the conductive patterns 151 and protruding terminals 153 can be connected electrically to connection pads on the board. Instead of mounting patterns, tail portions can be formed in each conductive pattern 151 which extend in the width direction of the main body portion 111 and protrude outward from the base film 115 so that the tail portions can be connected to the connection pads of the board.

A reinforcing metal fitting 156 is provided on one side of the conductive patterns 151. The reinforcing metal fittings 156 are formed along with the conductive patterns 151 by applying copper foil having a thickness ranging from several to several tens of μm on one surface of the base film 115, and then patterning the copper foil using etching so that the metal fittings extend in the traverse direction of the main body portion 111, and are provided on both ends of the main body portion 111 in the longitudinal direction separated from the conductive patterns 151.

In each reinforcing metal fitting 156 are formed a recessed portion 156*a* for insertion of a connector engaging lug portion 13 of the female connector 1 as explained below, and a fixing lug portion 156*b* extending to the outside in the longitudinal direction of the main body portion 111. The bottom surface of the fixing lug portion 156*b* is exposed on the mounting surface of the main body portion 111, and the exposed portion is connected to a fixing pad formed on the surface of the board, for example, via soldering. In this way, the male connector 101 is secured to the board.

An engagement reinforcing plate 118, which is a flat, plate-like engaging portion, is provided on the surface of the reinforcing metal fitting 156 (that is, on the mated surface). This engagement reinforcing plate 118 is made of metal, for example, stainless steel, but may also be made of a different type of material such as a resin or a composite containing glass fibers or carbon fibers. Also, an insertion recessed portion 118*a* is formed in each engagement reinforcing plate 118 to insert a connector engaging lug portion 13 on the female connector 1.

The engagement reinforcing plate 118 is securely bonded to the reinforcing metal fitting 156 via a flat spacer member 157. Because the insertion recessed portion 118*a* is arranged at a position corresponding to the recessed portion 156*a*, as shown in FIG. 2, a connector engaging recessed portion 113 is formed to engage the connector engaging lug portion 13 of the female connector 1. Because the dimensions of the insertion recessed portion 118*a* are smaller than the dimensions of the recessed portion 156*a*, an eave-like retaining portion 113*b* and a retaining recessed portion 113*a* covered by the retaining portion 113*b* are formed near the front end 111*a* of the main body portion 111 in the connector engaging recessed portion 113.

A latching protrusion 118*b* is formed on the side wall positioned to the inside of the connector engaging recessed portions 113 and the insertion recessed portion 118*a* as another latching protrusion protruding towards the center of the male connector 101 in the width direction. The latching protrusion 118*b* is flat with a triangular shape. The portions near the front end portion 111*a* and the rear end portion 111*b* of the latch protrusion 118*b* in the insertion recessed portion 118*a* become the front end latching recessed portion 118*c* and the rear end latching recessed portion 118*d*.

In the present embodiment, the female connector 1 is the first connector or the connector, and has a rectangular planar shape. It is connected electrically to the male connector 101 or the second connector. The female connector 1 may be mounted on a mounting member such as a printed circuit board, a flexible flat cable, or a flexible circuit board. In the present embodiment, it is connected to the end portion of a flat cable 91 such as a flexible flat cable or flexible circuit board described below.

In the example shown in the drawing, the female connector 1 has a flat cable connecting portion 12 connected to the flat cable 91, and a flat main body portion 11 formed in or connected to the end of the cable connecting portion 12. The main body portion 11 and the cable connecting portion 12 comprise, in order from the side opposite the mated surface (from the top in FIG. 5), the following: an engagement reinforcing plate 16 in the shape of a plate-like member serving as a reinforcing plate portion; a bonding layer 18 composed of an adhesive, a base film 15 serving as an insulating layer or female base portion, which is an insulating thin plate-like member shared with the cable connecting portion 12; wiring lines 61, which are conductive wires arranged in parallel rows on one side (the bottom side in FIG. 5) of the base film 15; cover film 17, which is an insulating layer serving as a plate-like female covering portion for covering the wiring lines 61 and as an insulating thin plate-like member shared with the cable connecting portion 12; a plurality of flat terminals 51 serving as flat terminal members or female connectors; and a reinforcing layer 19 serving as a sheet-like insulating layer covering the flat terminals 51.

A cable connection reinforcing layer 63 is arranged on both sides of the wiring lines 61 in the same layer as the wiring lines 61. The flat terminals 51 are present only in the main body portion 11, and a terminal reinforcing layer 56 is provided in the same layer of the flat terminals 51 in the cable connecting portion 12. An auxiliary reinforcing layer 19*b* is arranged in the same layer as the reinforcing layer 19 but in a position corresponding to the terminal reinforcing layer 56.

The flat terminals 51 have a substantially flat oval shape and are separated by terminal separating spaces 52. Each wiring line 61 is connected electrically to the corresponding conductive connecting pad 95 or conductive trace in the flat cable 91. The dimension of the main body portion 11 in the thickness direction is approximately from 0.3 to 0.5 mm, but this dimension can be changed if necessary.

The base film 15 and cover film 17 can be made of any insulating material, including a resin such as polyimide. The engagement reinforcing plate 16, reinforcing layer 19, and auxiliary reinforcing layer 19*b* are made of a metal such as stainless steel, but can also be made of some other material such as a resin or a composite material containing glass fibers or carbon fibers.

The wiring lines 61 are formed, for example, by patterning (for example, etching) copper foil with a thickness from several to several tens of μm affixed to one side of the base film 15, so as to arrange the wires in parallel at a predetermined pitch.

The flat terminals 51 are formed, for example, by patterning (for example, etching) copper foil with a thickness from several to several tens of μm affixed to one side of the cover film 17, so as to arrange the terminals in a row along the front end 11*a* of the main body portion 11 extending in the traverse direction (width direction) of the female connector 1 and a row formed near the cable portion 12, and so that adjacent flat terminals 51 in the same row and adjacent rows are separated from each other and arranged at a predetermined pitch. The pitch is established so as to be equal to the pitch of the conductive pattern 151 in the male connector 101 and the pitch of the wiring lines 61.

The row along the front end 11*a* and the row near the cable connecting portion 12 are arranged so as to be staggered one-half pitch relative to the traverse direction of the female connector 1. In other words, the flat terminals 51 in the row along the front end 11*a* and the flat terminals 51 in the row near the cable connecting portion 12 are arranged so as to be staggered by one-half pitch relative to the traverse direction of the female connector 1.

Figure 5:
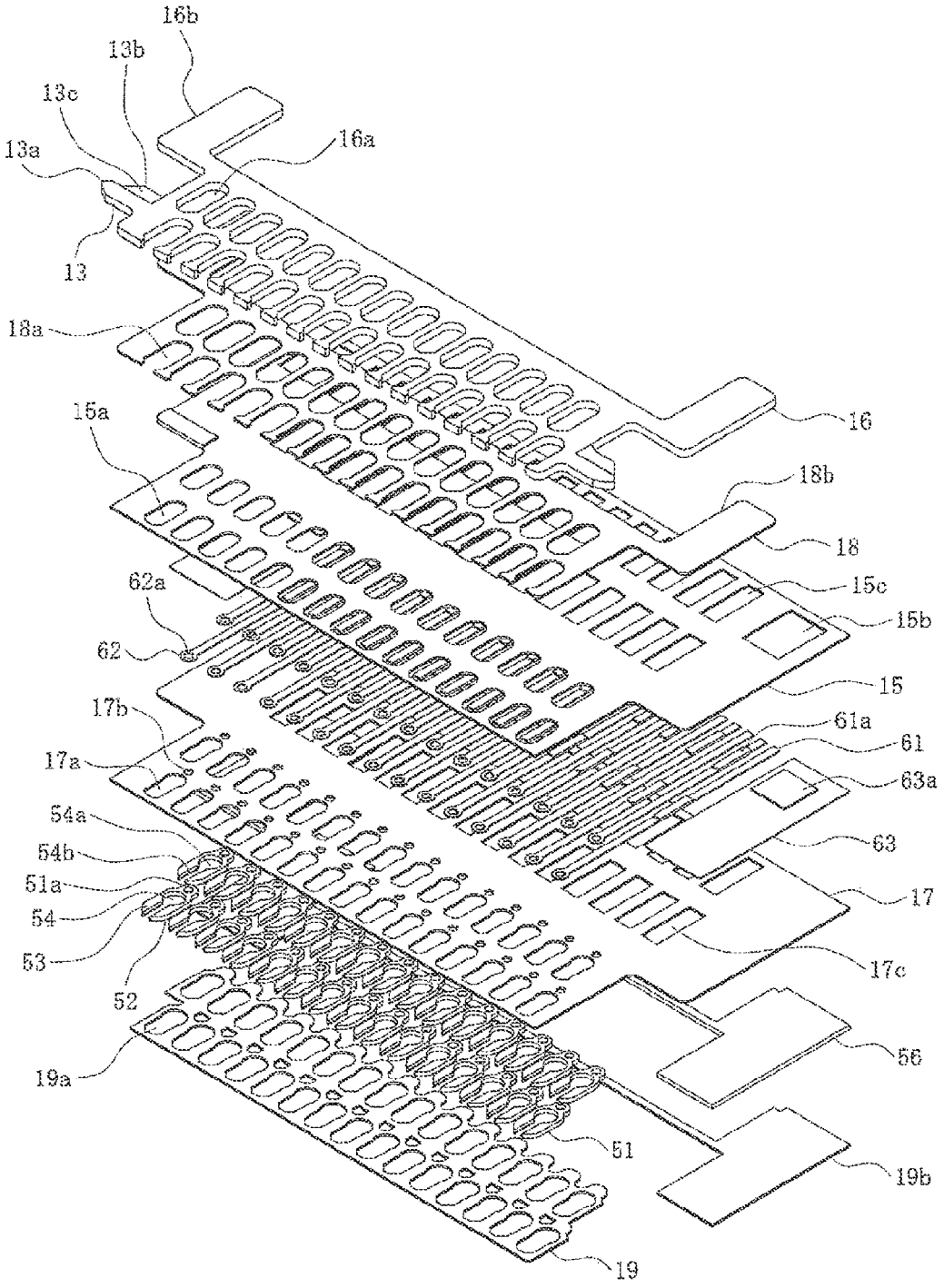
FIG. 5 is an exploded view of the female connector of FIG. 1.

Each flat terminal 51 has an opening 54 serving as a protruding terminal accommodating opening having a bottle-shaped or spoon-shaped planar shape, and an arm portion 53 and terminal connecting hole 51*a* serving as a first terminal member for demarcating the left and right sides of the opening 54. Each opening 54 receives and accommodates a protruding terminal 153 on the male connector 101 when a flat terminal 51 is mated with the protruding terminal 153. Each opening 54 has a circular or egg-shaped large-diameter portion 54*a* and a passage-like small-diameter portion 54*b* connected to the front end 11*a* of the main body portion 11 in the large-diameter portion 54*a* and extending towards the front end 11*a*. The edge of the small-diameter portion 54*b* on the front end 11*a* of the main body portion 11 may be open or closed as shown in FIG. 5.

The large-diameter portion 54*a* receives the protruding terminal 153 from the front end portion 153*b*, and the dimensions of the inner portion are greater than the outer dimensions of the front end portion 153*b* of the protruding terminal 153. In this way, a protruding terminal 153 can be inserted smoothly into the opening 54 when the flat terminal 51 is mated with the protruding terminal 153. The small-diameter portion 54*b* allows the protruding terminal 153 inserted into the large-diameter portion 54*a* to be slidably moved when the female connector 1 is slid to the rear relative to the male connector 101.

The width dimensions of small-diameter portion 54*b* are equal to or slightly smaller than the diameter or width dimension of the side portions 153*c* of the protruding terminal 153. As a result, when the protruding terminal 153 is moved into the small-diameter portion 54*b*, both arm portions 53 come into contact with the side surface portions 153*c* of the protruding terminal 153 and are elastically displaced. In other words, the interval between the arm portions is widened. Because the protruding terminal 153 receives pressure from the arm portions 53, the electrical connection between the protruding terminal 153 and the flat terminal 51 remains reliable.

A terminal accommodating opening 19*a* is formed in the reinforcing layer 19 in a position corresponding to the opening 54 in each flat terminal 51. The terminal accommodating openings 19*a* are arranged in two rows so as to be staggered at half a pitch from each other similar to the flat terminals 51. The terminal accommodating openings 19*a* pass through the reinforcing layer 19 in the thickness direction. The terminal accommodating openings 19*a* have an oval or round planar shape, and are larger in size than the openings 54 but smaller in size than the external shape of the flat terminals 51.

Figure 1B:
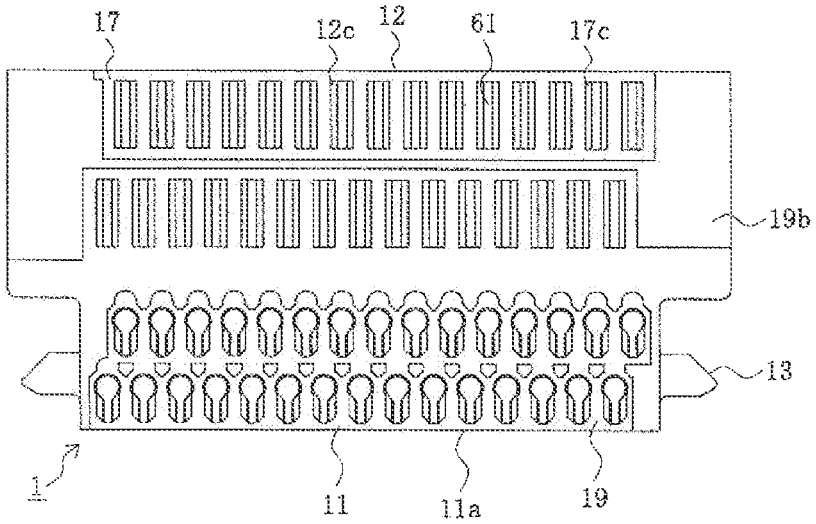

A terminal accommodating opening 17*a* and a through-hole 17*b* are formed in the cover film 17 in positions corresponding to the opening 54 and terminal connecting hole 51*a* for each flat terminal 51. In other words, the terminal corresponding holes 17*a* and through-holes 17*b* are arranged in two rows so as to be staggered at half a pitch from each other similar to the flat terminals 51. The terminal accommodating openings 17*a* and the through-holes 17*b* pass through the cover film 17 in the thickness direction. The terminal accommodating openings 17*a* have an oval or round planar shape, and are larger in size than the openings 54 and smaller in size than the external shape of the flat terminals 51. Wiring line accommodating openings 17*c* are formed in the portion of the cover film 17 corresponding to the cable connecting portion 12 and are openings passing through the cover film 17 in the thickness direction in positions corresponding to the connecting protrusions 61*a* of each wiring line 61. The surface on the mating surface for the corresponding wiring line 61 is exposed in each wiring line accommodating opening 17*c*. As shown in FIG. 1(*b*), the wiring line accommodating openings 17*c* are preferably wider than the corresponding wiring lines 61 and longer than the connecting protrusions 61*a*.

Figure 4:
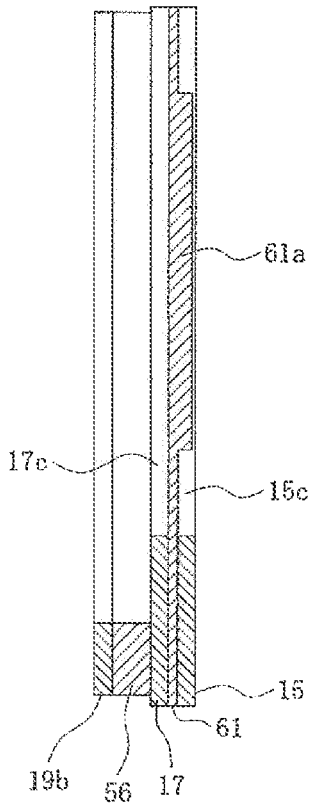
FIG. 4 is a simplified cross-sectional view of the female connector of FIG. 1, from Arrow A-A in FIG. 1.

A substantially rounded connecting end portion 62 is formed on the tip of each wiring line 61, and a wiring line connecting hole 62*a* is formed in each connecting end portion 62. The wiring line connecting holes 62*a* are centered on the wiring lines 61, and pass through the wiring lines 61 in the thickness direction. The connecting protrusions 61*a* are formed on the side opposite the mating surface of each wiring line 61, and are connected as a conductive connecting portion to the connecting pads 95 serving as the conductive trace connecting portions of the flat cable 91. As shown in FIG. 4, the connecting protrusions 61*a* are thick protrusions formed integrally with the wiring lines 61 using etching, and protrude from the surface opposite the mating surfaces of the wiring lines 61. The surface opposite the mating surface is preferably substantially the same height as the surface of the base film 15 opposite the mating surface. Each wiring line 61 is positioned so the wiring line connecting hole 62*a* is aligned with a terminal connecting hole 51*a* in a flat terminal 51 and a through-hole 17*b* in the cover film 17, and so the connecting protrusion 61*a* is aligned with a wiring line accommodating opening 17*c* in the cover film 17.

A reinforcing protrusion 63*a* is formed on the surface of the cable connection reinforcing film 63 on the side opposite the mating surface on both the left and right ends of the wiring lines 61. This serves as a connection reinforcing portion which is connected to a reinforcing pad 96 of the flat cable 91. Each reinforcing protrusion 63*a* is integrally formed with the cable connection reinforcing layer 63 using etching, and protrudes from the surface of the cable connection reinforcing layer 63.

The terminal connecting hole 51*a* in each flat terminal 51 on the lower surface of the cover film 17; that is, the layer on the mated side is connected electrically to the wiring line connecting hole 62 of the corresponding wiring line 61 on the upper surface of the cover film 17; that is, in the layer opposite the mated side via the conductive material in a through-hole 17*b*. In other words, the flat terminals 51 and wiring lines 61 are arranged in different layers of the female connector 1 and are connected electrically via a conductive material.

The connecting end portions 62 and wiring line connecting holes 62*a* of the wiring lines 61 are arranged in two rows so as to be staggered at half a pitch from each other similar to the flat terminals 51. Accordingly, the connecting protrusions 61*a* are also arranged in two rows so as to be staggered at half a pitch from each other. In other words, the wiring lines 61 are arranged so that the long wiring lines 61 with a connecting end portion 62 and connecting protrusion 61*a* at the tip closer to the front end 11*a* of the main body portion 11 alternate with the short wiring lines 61 with a connecting end portion 62 and connecting protrusion 61*a* at the tip farther from the front end 11*a* of the main body portion 11. The long wiring lines 61 pass between adjacent flat terminals 51 in the row closer to the cable connecting portion 12 when viewed from above.

A terminal accommodating opening 15*a* is formed in the base film 15 for the opening 54 of each flat terminal 51. In other words, the terminal accommodating openings 15*a* are also arranged in two rows so as to be staggered at half a pitch from each other similar to the flat terminals 51. The terminal accommodating openings 15*a* have an oval or round planar shape, and are larger in size than the openings 54 but smaller in size than the external shape of the flat terminals 51. The wiring line accommodating openings 15*c* are formed in the portion of the base film 15 corresponding to the cable connecting portion 12 so as to align with the connecting protrusion 61*a* of each wiring line 61. These openings 15*c* pass through the base film 15 in the thickness direction. Each wiring line accommodating opening 15*c* exposes a thick connecting protrusion 61*a* of a wiring line 61 formed on the surface opposite the mated surface. The surface of the connecting protrusions 61*a* on the surface opposite the mated surface is preferably substantially the same height as the surface of the base film 15 opposite the mated surface. The connecting protrusions 61*a* are connected to the connecting pads 95 of the flat cable 91 using a means such as soldering. As shown in FIG. 1(*a*), the wiring line accommodating opening 15*c* is preferably wider than the corresponding wiring line 61 and longer than the connecting protrusion 61*a*.

A plurality of connecting portion accommodating openings 12*c* are formed so as to pass through the cable connecting portions 12 along with the wiring line accommodating openings 15*c* and the wiring line accommodating openings 17*c* of the cover film 17. The connecting portion accommodating openings 12*c* are wider than the connecting protrusions 61*a*.

A reinforcing protrusion accommodating opening 15*b* is formed on both the left and right sides of the wiring line accommodating openings 15*c* in the base film 15 so as to align with the reinforcing protrusions 63*a* on the cable connection reinforcing layer 63. Each of the reinforcing protrusion accommodating openings 15*b* exposes a reinforcing protrusion 63*a* on the cable connection reinforcing layer 63, and the surface of the reinforcing protrusions 63*a* are preferably substantially the same height as the surface of the base film 15 opposite the mated surface.

Terminal accommodating openings 16*a* are also formed in the engagement reinforcing plate 16 so as to be aligned with the openings 54 in each flat terminal 51. In other words, the terminal accommodating openings 16*a* are arranged in two rows so as to be staggered at half a pitch from each other similar to the flat terminals 51. The terminal accommodating openings 16*a* pass through the engagement reinforcing plate 16 in the thickness direction. The terminal accommodating openings 16*a* have an oval or round planar shape, and are larger in size than the openings 54 but smaller in size than the external shape of the flat terminals 51. A pair of arm portions 16*b* extend to the rear in the portion of the engagement reinforcing plate 16 corresponding to the cable connecting portion 12. The connection recessed portion 12*a* on the surface of the cable connecting portion 12 opposite the mated surface is defined on three sides by the engagement reinforcing plate 16. The front end portion 91*a* of the flat cable 91 described below is accommodated inside the connecting recessed portion 12*a*.

Terminal accommodating openings 18*a* are formed in the bonding layer 18 on the surface of the engagement reinforcing plate 16 opposite the mated surface so as to be aligned with the opening 54 in each flat terminal 51. In other words, the terminal accommodating openings 18*a* are arranged in two rows so as to be staggered at half a pitch from each other similar to the flat terminals 51. The terminal accommodating openings 18*a* pass through the bonding layer 18 in the thickness direction. The terminal accommodating openings 18*a* have an oval or round planar shape, and are larger in size than the openings 54 but smaller in size than the external shape of the flat terminals 51. A pair of arm portions 18*b* extend to the rear in the portion of the bonding layer 18 corresponding to the cable connecting portion 12 as in the case of the engagement reinforcing plate 16.

A connector engaging lug portion 13 extending to the outside of the female connector 1 is formed on both the left and right sides of the engagement reinforcing plate 16 in the portion corresponding to the main body portion 11. When the female connector 1 is mated with the male connector 101, the connector engaging lug portion 13 engages the connector engaging recessed portion 113 in the male connector 101 to keep the female connector 1 from becoming detached from the male connector 101.

An inserted retaining portion 13*c* and an eave-like retaining portion 13*b* covering the retaining portion 13*c* are formed on the rear end of the connector engaging lug portion 13 (the end with the cable connecting portion 12). When the connector engaging lug portion 13 is engaged with the connector engaging recessed portion 113 and slides further towards the front end 111*a* of the male connector 101 than the female connector 1 in the male connector 101, the retaining protrusion 13*b* and the retaining portion 13*c* engage the retaining recessed portion 113*a* and the retaining portion 113*b* in the connector engaging recessed portion 113, and the connector engaging lug portion 13 is kept from becoming detached from the connector engaging recessed portion 113.

A latching protrusion 13*a* is formed in the connector engaging lug portion 13 which protrudes to the outside in the width direction of the female connector 1. The latching protrusion 13*a* has a triangular planar shape, and is able to engage the front end latching recessed portion 118*c* and rear end latching recessed portion 118*d* in the insertion recessed portion 118*a* of the male connector 101.

The terminal accommodating openings 15*a*, reinforcing protrusion accommodating openings 15*b* and wiring line accommodating openings 15*c* in the base film 15 as well as the terminal accommodating openings 17*a*, the through-holes 17*b* and the wiring line accommodating openings 17*c* in the cover film 17 can be created by etching the base film 15 and the cover film 17 using an alkaline etchant.

In the present embodiment, the flat cable 91 is a flexible circuit board or flexible flat cable. However, any type of cable can be used. It can even be rigid instead of flexible. The flat cable 91 has a base film 92, which is a thin, slender insulating sheet serving as the sheet-like base portion, and a cover film 93, which is a thin, slender insulating sheet serving as the sheet-like covering portion used to cover the rows of conductive traces (not shown) and the entire surface of the base film 92 containing the conductive traces (the lower surface in FIG. 8(*a*)). In other words, the flat cable 91 is a flat member with a layered structure in which the base film 92, conductive traces, and cover film 93 have been laminated in successive order.

The conductive traces are foil-like linear bodies made of a conductive material such as copper which are arranged in parallel at a predetermined pitch with respect to each other. The number, pitch and arrangement of the conductive traces is identical to those of the wiring lines 61 in the female connector 1. These can be changed if necessary. The flat cable 91 is a long, slender member, but the rear portion (below in FIG. 7) has been removed from the drawing for the sake of simplicity.

The base film 92 and the cover film 93 are made of a resin such as polyimide, but can be made of any other type of insulating material. The conductive traces can be formed by applying copper foil on one surface of the base film 92 to a thickness of several or several tens of μm and then etching and patterning the copper foil.

The front end portion 91*a* of the flat cable 91 has a wide portion 91*a*2 which is the same width as the rest of the cable, and a narrow portion 91*a*1 which is narrower than the wide portion 91*a*2 and which extends forward from the wide portion 91*a*2. Connecting pad accommodating openings 93*a* are formed in the portion of the cover film 93 corresponding to the front end portion 91*a* so as to be aligned with the connecting portion accommodating openings 12*c* formed in the cable connecting portion 12 of the female connector 1. Each of the connecting pad accommodating openings 93*a* exposes a connecting pad 95 serving as a conductive trace connecting portion.

Each of the connecting pads 95 is the portion of each conductive trace that is exposed by a connecting pad accommodating opening 93*a* and that is connected to the connecting protrusion 61*a* of a wiring line 61 in the female connector 1. The connecting pads 95 are preferably wider than the rest of the conductive trace. Also, because the cover film 93 is very thin, the surface of the exposed connecting pads 95 should be the same height as the surface of the cover film 93.

The connecting pad accommodating openings 93*a* and the connecting pads 95 are arranged in two rows so as to be staggered by half a pitch. More specifically, the row in narrow portion 91*a*1 and the row in the wide portion 91*a*2 are arranged so as to be staggered by half a pitch relative to the width direction of the flat cable 91. The conductive traces formed by the connecting pads 95 in the narrow portion 91*a*1 pass between adjacent connecting pads 95 in the row in the wide portion 91*a*2 when viewed from above.

A reinforcing pad accommodating opening 93*b* is formed on both the left and right sides of the connecting pads 95 in the wide portion 91*a*2 of the cover film 93, and a reinforcing pad 96 is exposed in each reinforcing pad accommodating opening 63*b*. Each reinforcing pad 96 exposed in the reinforcing pad accommodating opening 93*b* is a portion of the grand lines (not shown) in the flat cable 91, and is connected to the reinforcing protrusion 93*a* in the cable connection reinforcing layer 63 of the female connector 1. The reinforcing pads 96 are preferably wider than the other portion of the grand lines. Because the cover film 93 is very thin, the surface of the exposed reinforcing pads 96 is preferably substantially the same height as the cover film 93.

Figure 7:
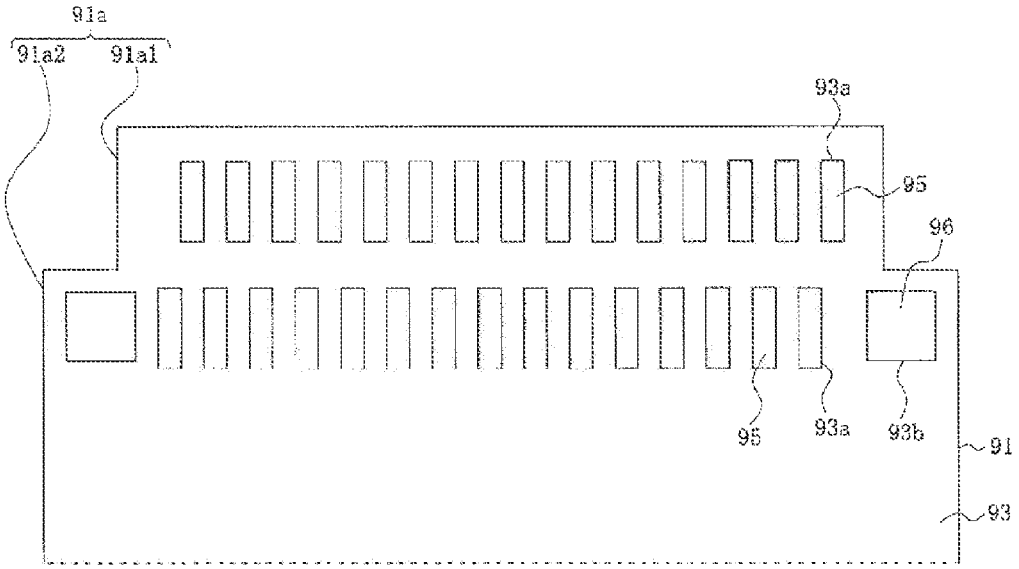
FIG. 7 is a plan view showing the front end near the flat cable.
Figure 8A:
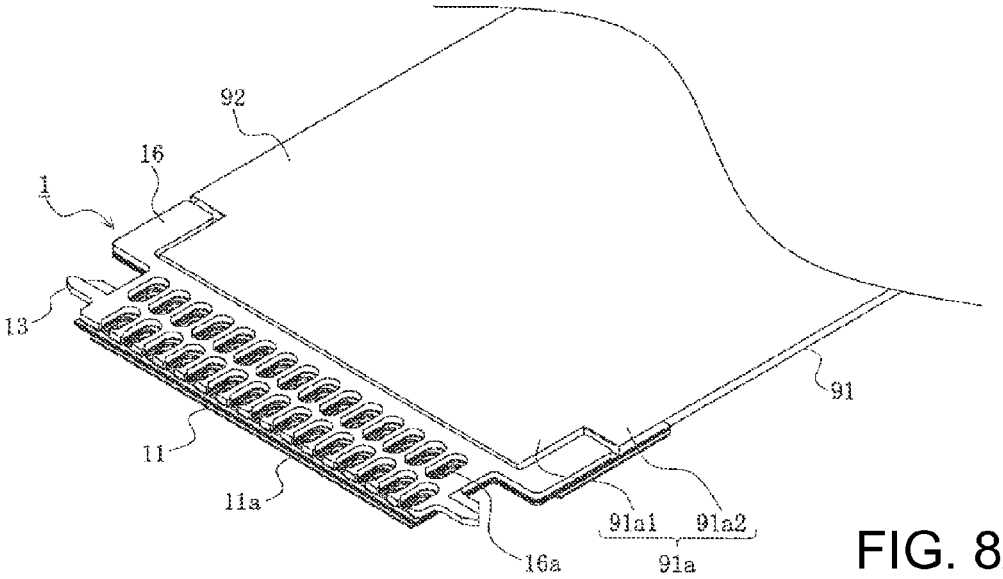
FIG. 8 is a diagram of the female connector of FIG. 1, connected to the front end of a flat cable, in which FIG. 8(*a*) is a perspective view of the female connector from the side opposite the mated surface, and FIG. 8(*b*) is a perspective view of the female connector from the side with the mated surface.
Figure 8B:
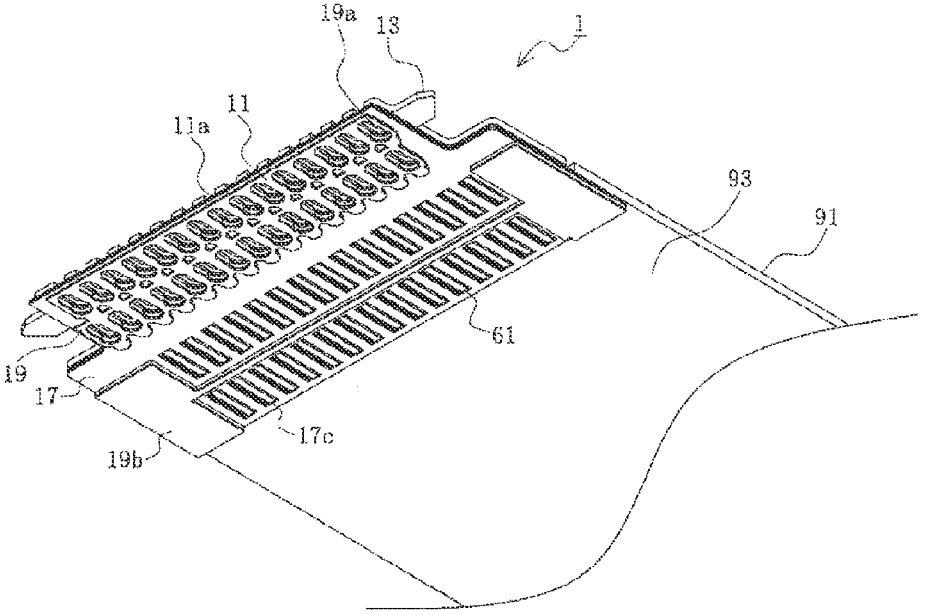

When a flat cable 91 is connected to the female connector 1, first, as shown in FIG. 7, the surface in the front end portion 91*a* of the flat cable 91 in which the connecting pads 95 are exposed faces the surface of the cable connecting portion 12 of the female connector 1 opposite the mated surface. As shown in FIG. 8(*a*), the front end portion 91*a* of the flat cable 91 is accommodated inside the connecting recessed portion 12*a* of the cable connecting portion 12 of the female connector 1. The connecting pads 95 and the connecting protrusion 61*a* on the corresponding wiring lines 61 are connected using solder, and the reinforcing pads 96 and the reinforcing protrusions 63*a* on the cable connection reinforcing layer 63 are also connected using solder. More specifically, solder paste is applied beforehand to the surfaces of the connecting pads 95 and reinforcing pads 96 or to the surfaces of the connecting protrusions 61*a* or reinforcing protrusions 63*a*, and the front end portion 91*a* of the flat cable 91 is soldered using the reflow of heated solder housed inside the connecting recessed portion 12*a* of the cable connecting portion 12 of the male connector 1. In this way, the flat cable 91 is connected to the female connector 1 as shown in FIGS. 8(*a*)-(*b*).

In the present embodiment, the connecting protrusions 61*a* and the reinforcing protrusions 63*a* protrude towards the surface opposite the mated surface. Consequently, the surfaces of the connecting protrusions 61*a* and the reinforcing protrusions 63*a* come close to or make contact with the surfaces of the corresponding connecting pads 95 and reinforcing pads 96 with the front end portion 91*a* of the flat cable 91 housed inside the connecting recessed portion 12*a* of the cable connecting portion 12 of the female connector 1. Because of this configuration, the connecting protrusions 61*a* and the reinforcing protrusions 63*a* can be reliably soldered and firmly secured to the connecting pads 95 and reinforcing pads 96. In this way, a reliable connection is established between each wiring line 61 and corresponding conductive trace. The physical connection between the flat cable 91 and the female connector 1 is also reliable and secure.

Figure 6A:
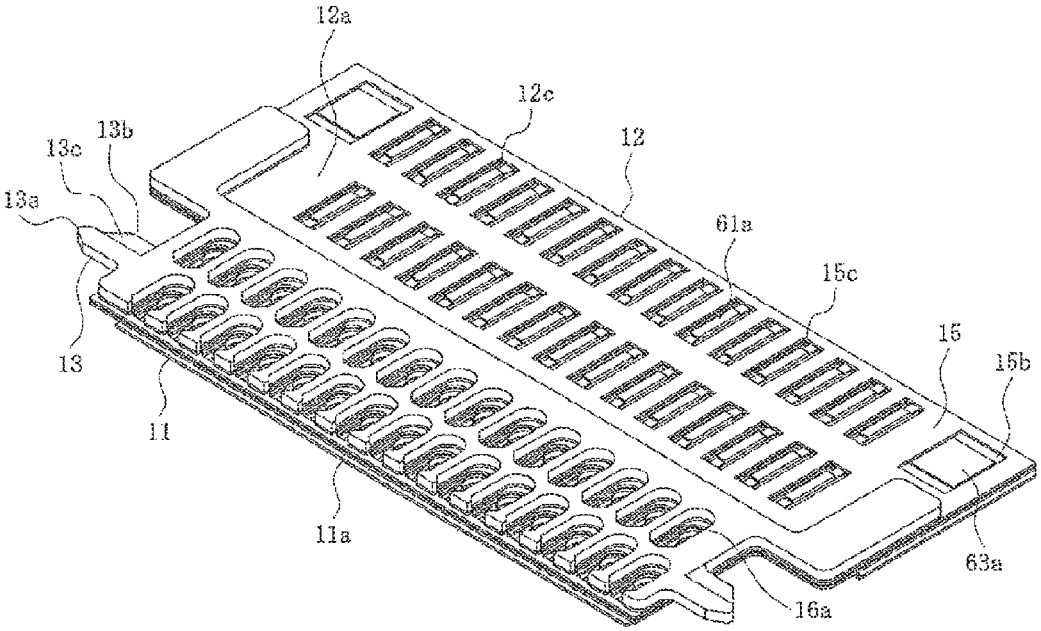
FIG. 6 is a diagram of the female connector of FIG. 1 from the side opposite the mated surface, in which FIG. 6(*a*) is a perspective view, and FIG. 6(*b*) is a perspective view of the wiring layer only.
Figure 6B:
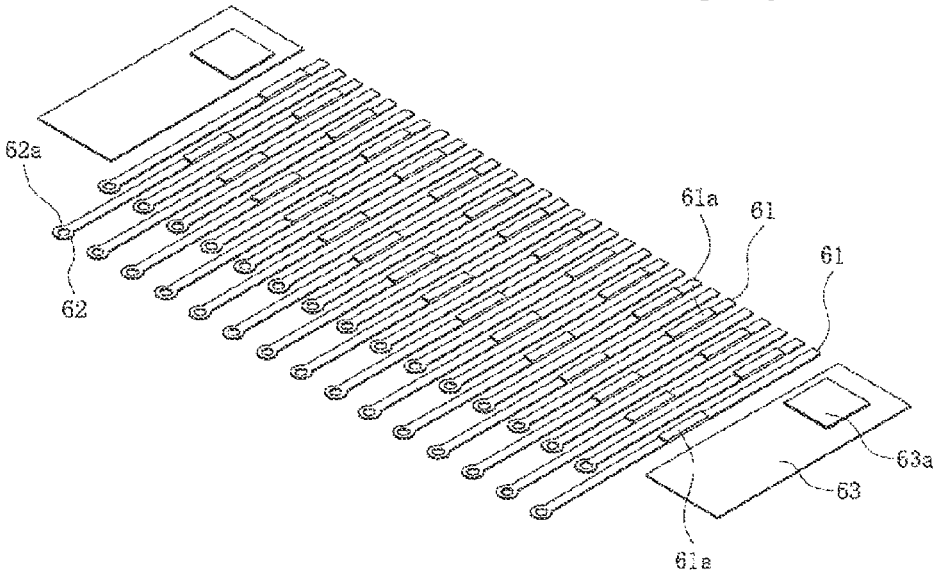

Because, as shown in FIG. 6(*a*), a recessed portion is formed around each connecting protrusion 61*a* aligned with a wiring line accommodating opening 15*c* or connecting portion accommodating opening 12*c*, the excess solder remains inside the recessed portion even when a large amount of molten solder is used. This keeps the molten solder from flowing towards other components. This reliably prevents shorts caused by solder flowing between adjacent connecting protrusions 61*a* or connecting pads 95.

Because, as shown in FIG. 8(*b*), a wiring line accommodating opening 17*c* is formed in the cover film 17 for each connecting protrusion 61*a*, the solder connections between the connecting protrusions 61*a* and the connecting pads 95 are visible from the mated surface of the female connector 1 via the wiring line accommodating openings 17*c*. This allows the connections between the connecting protrusions 61*a* and the connecting pads 95 to be visually inspected.

Also, as shown in FIG. 8 (*a*), the outer surface of the base film 92 and the surface of the engagement reinforcing plate 16 of the female connector 1 opposite the mated surface are substantially flush with the front end portion 91*a* of the flat cable 91 accommodated inside the connecting recessed portion 12*a* of the cable connecting portion 12 of the female connector 1. As a result, the female connector 1 has a lower profile when the flat cable 91 is connected.

In operation, the operator holds the mated surface of the male connector 101 (the upper surface in FIG. 2) opposite the mated surface of the female connector 1 (the surface shown in FIG. 1(*b*)), lowers the female connector 1 towards the male connector 101 in the mating direction, and brings the mated surface of the male connector 101 closer to or into contact with the mated surface of the female connector 1.

Figure 9A:
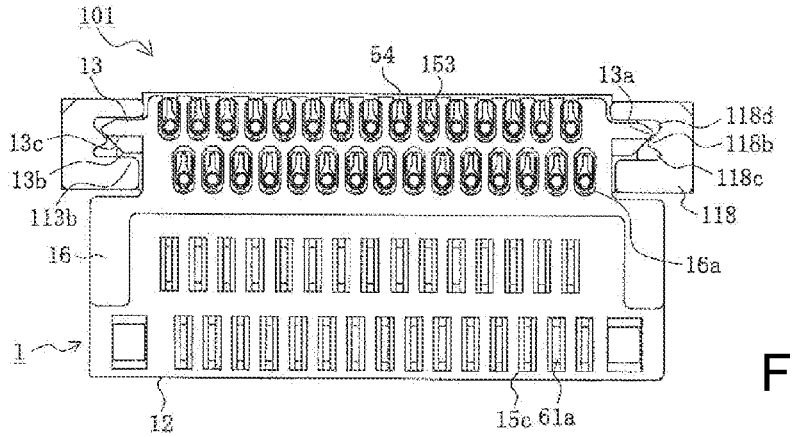
FIG. 9 is a plan view showing the mating operation for the male connector and the female connector, in which FIGS. 9(*a*) through (*c*) show each step in the mating operation.
Figure 9B:
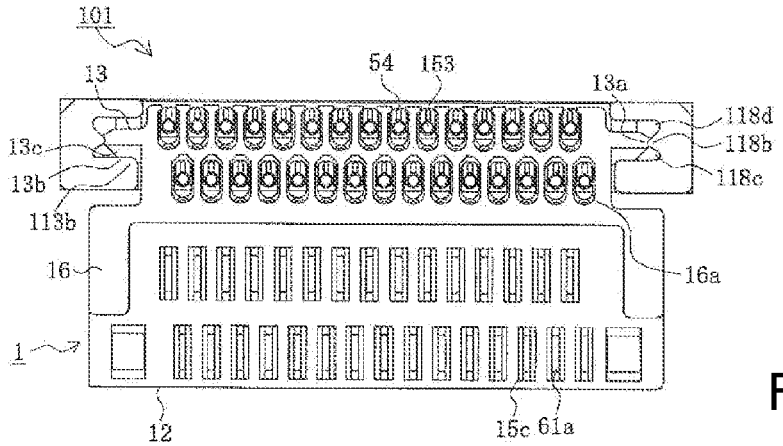
Figure 9C:
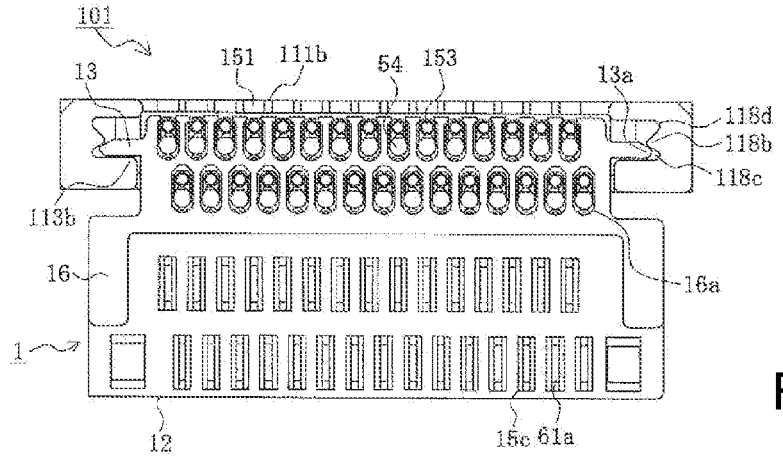

With this, as shown in FIG. 9(*a*), the left and right connector engaging lug portions 13 of the female connector 1 enter the left and right connector engaging recessed portions 113 of the male connector 101, and each protruding terminal 153 of the male connector 101 enters the large diameter portion 54*a* of the opening 54 in the corresponding flat terminal 51 of the female connector 1.

Figure 10:
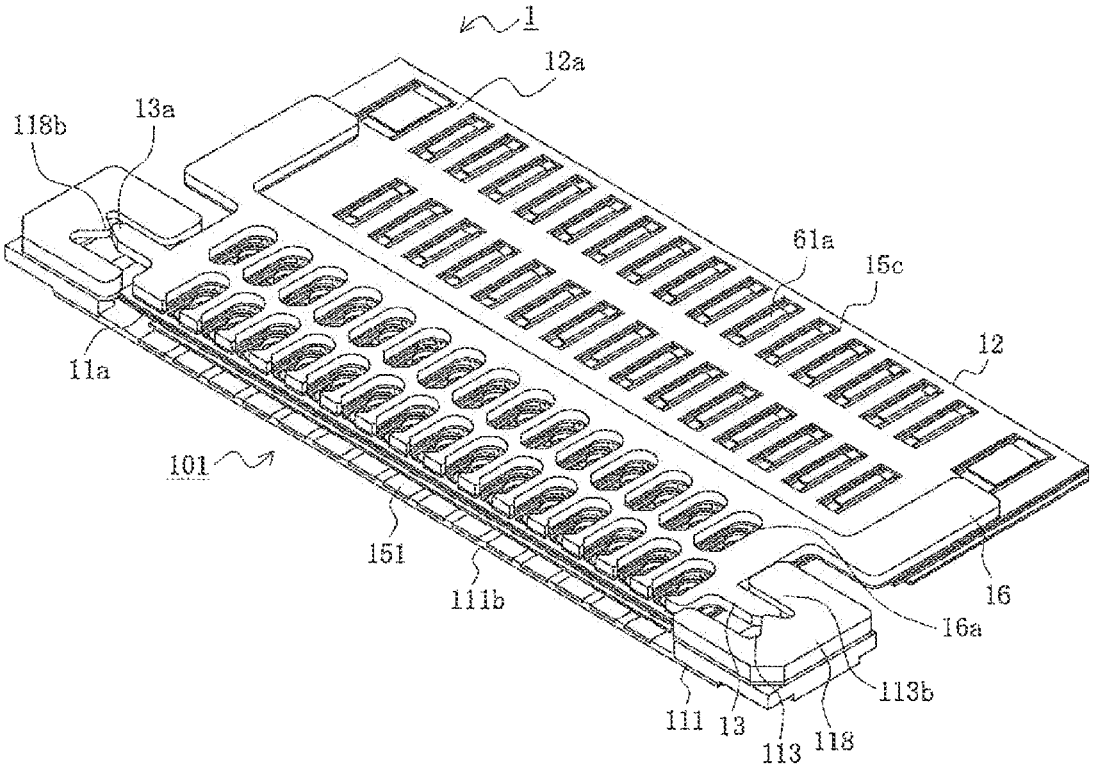
FIG. 10 is a perspective view showing the mated male and female connectors.
Figure 11:
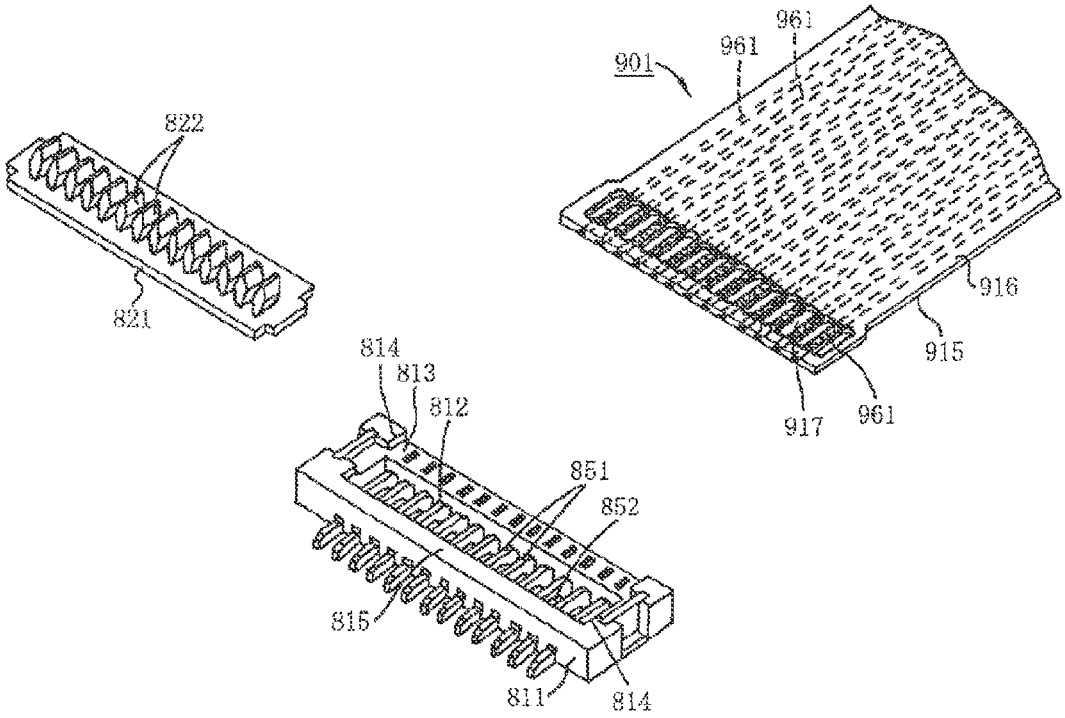
Prior art FIG. 11
FIG. 11 is an exploded view of a conventional connector.

Depiction of the flat cable 91 has been omitted from FIGS. 9-10 for the sake of simplicity.

Because the inner dimensions of the connector engaging recessed portions 113 are greater than the outer dimensions of the connector engaging lug portions 13, the connector engaging lug portions 13 can enter the connector engaging recessed portions 113 smoothly. Also, because the inner dimensions of the rear end latching recessed portions 118*d* positioned to the inside of the connector engaging recessed portions 113 are larger than the outer dimensions of the latching protrusions 13*a* at the front end of the connector engaging lug portions 13, the latching protrusions 13*a* can smoothly enter the rear end latching recessed portions 118*d*. Because the inner dimensions of the large diameter portion 54*a* are larger than the outer dimensions of the front end portion 153*b* of the protruding terminals 153, the protruding terminals 153 can smoothly enter the large diameter portion 54*a*.

Next, the operator slides the female connector 1 relative to the male connector 101 in the direction of the front end 111*a* of the male connector 101. In other words, the female connector 1 is moved relative to the male connector 101 in the direction of the front of the male connector 101 with the mated surface of the male connector 101 and the mated surface of the female connector 1 either making contact or close to making contact.

With this, as shown in FIG. 9(*b*), the rear inclined surface of the latching protrusion 13*a* on the front end of both the left and the right connector engaging lug portions 13 comes into contact with the rear inclined surface of the latching protrusion 118*b* near the front end 111*a* of the rear end latching recessed portion 118*d*. Next, when the operator moves the female connector 1 relative to the male connector 101 towards the front of the male connector 101, the latching protrusions 13*a* of the female connector 1 and/or the latching protrusions 118*b* of the male connector 101 are elastically deformed, and the latching protrusions 13*a* of the female connector 1 ride up over the latching protrusions 118*b* of the male connector 101 and easily enter the front end latching recessed portions 118*c* as shown in FIG. 9(*c*). When the latching protrusions 13*a* of the female connector 1 ride up over the latching protrusions 118*b* of the male connector 101, the elastic deformation of the latching protrusions 13*a* of the female connector 1 and/or the latching protrusions 118*b* of the male connector 101 generates a rebound. It may also generate vibrations or a noise. The operator can sense this rebound via the vibrations and/or the sound of a click.

The protruding terminals 153 positioned inside the large diameter portion 54*a* of the openings 54 in the flat terminals 51 move towards the small diameter portion 54*b*. When the protruding terminals 153 enter the small diameter portion 54*b*, both arm portions 53 come into contact with the side surfaces 153*c* of the protruding terminals 153, and are elastically deformed. In other words, the space between them is widened. Consequently, the protruding terminals 153 are subjected to pressure from the arm portions 53, and a reliable electrical connection is maintained between the protruding terminals 153 and the flat terminals 51.

When the male terminal 101 and the female terminal 1 have been mated in this way, as shown in FIG. 9(*c*) and FIG. 10, the retaining protrusions 13*b* and the retaining portions 13*c* of the connector engaging lug portions 13 engages the retaining recessed portions 113*a* and the retaining portions 113*b* of the connector engaging recessed portions 113 and are retained. This keeps the connector engaging lug portions 13 from becoming detached from the connector engaging recessed portion 113, and the mated male connector 101 and female connector 1 are reliably kept from becoming disengaged.

The latching protrusions 13*a* are inserted into the front end latching recessed portions 118*c* where they are engaged and secured. Because the female connector 1 can no longer slide relative to the male connector 101 in the direction of detachment, the retaining protrusions 13*b* and the retaining portions 13*c* of the connector engaging lug portions 13 and the retaining recessed portions 113*a* and the retaining portions 113*b* of the connector engaging recessed portions 113 are reliably kept from becoming disengaged.

The operations performed to detach the mated male connector 101 and female connector 1 are the exact opposite of the operations performed to mate the male connector 101 with the female connector 1, so further explanation has been omitted.

In the explanation of the present embodiment, there were two rows of conductive patterns 151 and plate-like terminals 51. However, the number of rows is not limited to two. There can be more rows than this. The conductive patterns 151 in one row and the conductive patterns 151 in an adjacent row may be staggered with respect to the width direction of the main body portion 111, or the flat terminals 51 in one row and the flat terminals 51 in an adjacent row may be staggered in the width direction of the main body portion 11.

The female connector 1 in the present embodiment has a flat cable connecting portion 12 connected to a flat cable 91, and a flat main body portion 11 engaging the male connector 101. It also has a plurality of flat terminals 51 arranged on the main body portion 11 and making contact with the protruding terminals 153 of the male connector 101, a plurality of connecting protrusions 61*a* exposed in the cable connecting portion 12 and connected to the connecting pads 95 of the flat cable 91, and a plurality of wiring lines 61 extending from the main body portion 11 to the cable connecting portion 12 and electrically connecting each connecting protrusion 61*a* to the corresponding flat terminal 51. The connecting protrusions 61*a* are protrusions formed on the wiring lines 61, and the upper surface of the connecting protrusions 61*a* is the same height as the outer surface of the cable connecting portion 12.

Therefore, when the flat cable 91 is connected to the cable connecting portion 12, the upper surface of the connecting protrusions 61*a* can come close to or make contact with the connecting pads 95 of the flat cable 91, and the connecting protrusions 61*a* and the connecting pads 95 can be reliably connected using solder. Therefore, the flat cable 91 can be connected more easily and reliably, can be manufactured more easily, and can be made more reliable even while making the configuration of the female connector 1 simpler, more integrated, more compact, and lower in profile.

Also, the cable connecting portion 12 has a plurality of connecting portion accommodating openings 12*c* passing through in the thickness direction, and each connecting protrusion 61*a* is exposed inside each connecting portion accommodating opening 12*c*. Therefore, the solder connection between the connecting protrusions 61*a* and the connecting pads 95 can be visually inspected from the outside of the cable connecting portion 12 via the connecting portion accommodating openings 12*c*.

The connecting portion accommodating opening 12*c* is also wider than the connecting protrusions 61*a*. As a result, the remaining solder can be accommodated inside the connecting portion accommodating opening 12*c* surrounding the connecting protrusions 61*a* even when the amount of molten solder is increased. This stops the remaining solder from flowing towards surrounding components, and keeps adjacent connecting protrusions 61*a* or connecting pads 95 from being shorted by the flowing solder.

Also, the cable connecting portion 12 includes insulating base film 15 arranged on one surface of the wiring lines 61 and an insulating cover film 17 arranged on the other surface of the wiring lines 61; each connecting portion accommodating opening 12*c* includes a wiring line accommodating opening 15*c* passing through the insulating base film in the thickness direction and a wiring line accommodating opening 17*c* passing through the insulating cover film 17 in the thickness direction; and the upper surface of each connecting protrusion 61*a* is substantially the same height as the outer surface of the base film 15. As a result, the space between adjacent connecting protrusions 61*a* is reliably insulated by the base film 15 and the cover film 17 to prevent shorting even while simplifying the configuration of the cable connecting portion 12.

Also, the conductive connecting protrusions 61*a* are arranged side by side so as to form a plurality of rows extending in the width direction of the female connector 1, and conductive connecting protrusions 61*a* in adjacent rows are arranged so as to be staggered at half a pitch relative to each other in the thickness direction of the connector 1. As a result, the pitch of the wiring lines 61 can be narrowed and the wiring lines 61 integrated more densely while also maintaining space between adjacent connecting protrusions 61*a* exposed in the cable connecting portion 12 to prevent shorting.

While a preferred embodiment of the Present Disclosure is shown and described, it is envisioned that those skilled in the art may devise various modifications without departing from the spirit and scope of the foregoing Description and the appended Claims.

What is claimed is:

1. A connector having a flat cable connecting portion connected to a flat cable and a flat mating portion mated with another connector, the connector comprising:

a plurality of terminals arranged on the mating portion for establishing contact with terminals on the other connector;

a conductive connecting portion exposed on the cable connecting portion and connected to conductive trace connecting portions on the flat cable, and a plurality of wiring lines extending from the mating portion to the cable connecting portion, each one electrically connecting a terminal to the corresponding conductive trace connecting portion;

wherein the conductive connecting portion having a protrusion formed on the wiring lines, and the upper surface of the protrusion being substantially the same height as one outer surface of the cable connecting portion.

2. The connector of claim 1, wherein the cable connecting portion has connecting portion accommodating openings passing through the cable connecting portion in the thickness direction, and each conductive connecting portion is exposed inside each connecting portion accommodating opening.

3. The connector of claim 2, wherein each connecting portion accommodating opening is wider than the conductive connecting portion.

4. The connector of claim 3, wherein the cable connecting portion includes insulating base film arranged on one surface of the wiring lines and an insulating cover film arranged on the other surface of the wiring lines.

5. The connector of claim 4, wherein each connecting portion accommodating opening includes an opening passing through the insulating base film in the thickness direction and an opening passing through the insulating cover film in the thickness direction.

6. The connector of claim 5, wherein the upper surface of each protrusion is substantially the same height as the outer surface of the base film.

7. The connector of claim 6, wherein the conductive connecting portions are arranged side by side so as to form a plurality of rows extending in the width direction of the connector.

8. The connector of claim 7, wherein conductive connecting portions in adjacent rows are arranged so as to be staggered at half a pitch relative to each other in the thickness direction of the connector.

9. The connector of claim 1, wherein the conductive connecting portions are arranged side by side so as to form a plurality of rows extending in the width direction of the connector.

10. The connector of claim 9, wherein conductive connecting portions in adjacent rows are arranged so as to be staggered at half a pitch relative to each other in the thickness direction of the connector.

11. The connector of claim 2, wherein the conductive connecting portions are arranged side by side so as to form a plurality of rows extending in the width direction of the connector.

12. The connector of claim 11, wherein conductive connecting portions in adjacent rows are arranged so as to be staggered at half a pitch relative to each other in the thickness direction of the connector.

13. The connector of claim 3, wherein the conductive connecting portions are arranged side by side so as to form a plurality of rows extending in the width direction of the connector.

14. The connector of claim 13, wherein conductive connecting portions in adjacent rows are arranged so as to be staggered at half a pitch relative to each other in the thickness direction of the connector.

* * * * *